US011246337B2

(12) United States Patent
Malgat et al.

(10) Patent No.: US 11,246,337 B2
(45) Date of Patent: Feb. 15, 2022

(54) HEATED AEROSOL GENERATING ARTICLE WITH AIR-FLOW BARRIER

(71) Applicant: Philip Morris Products S.A., Neuchatel (CH)

(72) Inventors: Alexandre Malgat, Les Tuileries de Grandson (CH); Stephane Roudier, Colombier (CH); Ana Carolina Borges de Couraca, Lausanne (CH); Frederic Lavanchy, Chavomay (CH); Cedric Meyer, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 61 days.

(21) Appl. No.: 15/101,163

(22) PCT Filed: Dec. 4, 2014

(86) PCT No.: PCT/EP2014/076648
§ 371 (c)(1),
(2) Date: Jun. 2, 2016

(87) PCT Pub. No.: WO2015/082650
PCT Pub. Date: Jun. 11, 2015

(65) Prior Publication Data

US 2016/0295917 A1 Oct. 13, 2016

(30) Foreign Application Priority Data

Dec. 5, 2013 (EP) ..... 13195880

(51) Int. Cl.
*A24F 47/00* (2020.01)
*A24D 1/20* (2020.01)
(Continued)

(52) U.S. Cl.
CPC ..... *A24D 1/20* (2020.01); *A24F 40/46* (2020.01); *A24F 40/20* (2020.01)

(58) Field of Classification Search
CPC ..... A24F 47/008; A24F 40/20; A24D 1/20
See application file for complete search history.

(56) References Cited

U.S. PATENT DOCUMENTS 4,947,875 A * 8/1990 Brooks ..... A24F 47/006 128/202.21
5,730,158 A 3/1998 Collins et al.
(Continued)

FOREIGN PATENT DOCUMENTS

CH 691 156 A5 5/2001
CN 201067079 Y 6/2008
(Continued)

OTHER PUBLICATIONS

International Search Report and Written Opinion of the International Searching Authority dated May 8, 2015 in PCT/EP2014/076648 Filed Dec. 4, 2014.
(Continued)

*Primary Examiner* — Eric Yaary
(74) *Attorney, Agent, or Firm* — Oblon, McClelland, Maier & Neustadt, L.L.P.

(57) ABSTRACT

There is provided a heated aerosol-generating article for use with an aerosol-generating device having a heating element, the heated aerosol-generating article including an aerosol-forming substrate and a breachable air-flow barrier assembled within a wrapper to form a rod having a mouth end and a distal end upstream from the mouth end, in which the breachable air-flow barrier is positioned to substantially prevent air being drawn through the aerosol-forming substrate when a user draws on the mouth end of the rod, and
(Continued)

in which the aerosol-forming substrate comprises a gathered sheet of aerosol-forming material.

15 Claims, 2 Drawing Sheets

(51) Int. Cl.
*A24F 40/46* (2020.01)
*A24F 40/20* (2020.01)

(56) References Cited

U.S. PATENT DOCUMENTS 5,774,493 A * 6/1998 Ross ..... H04B 1/70718 375/142
5,894,841 A * 4/1999 Voges ..... A24F 47/008 128/203.12
6,085,745 A * 7/2000 Levander ..... A61M 15/0028 128/203.15
8,091,558 B2 1/2012 Martzel
8,156,944 B2 * 4/2012 Han ..... A24F 47/008 131/273
8,424,538 B2 * 4/2013 Thomas ..... A24F 47/006 131/194
8,517,032 B2 * 8/2013 Urtsev ..... A24F 47/002 131/271
8,813,759 B1 * 8/2014 Horian ..... A61M 15/06 128/202.21
9,737,093 B2 * 8/2017 Hon ..... A24F 47/008
9,854,839 B2 * 1/2018 Tucker ..... H01C 17/00
9,854,845 B2 * 1/2018 Plojoux ..... A24F 47/008
2004/0089314 A1 * 5/2004 Felter ..... A24F 47/008 131/194
2006/0196518 A1 * 9/2006 Hon ..... A24F 47/002 131/360
2008/0092912 A1 * 4/2008 Robinson ..... A24F 47/008 131/200
2008/0276947 A1 11/2008 Martzel et al.
2009/0095311 A1 * 4/2009 Han ..... A24F 47/008 131/194
2009/0126745 A1 5/2009 Hon
2010/0024834 A1 * 2/2010 Oglesby ..... A24F 47/006 131/194
2010/0186738 A1 * 7/2010 Kobayashi ..... A61M 15/0028 128/200.14
2010/0307518 A1 * 12/2010 Wang ..... A24F 47/008 131/329
2011/0209717 A1 9/2011 Han
2011/0271972 A1 11/2011 Thomas et al.
2011/0277760 A1 * 11/2011 Terry ..... A24F 47/008 128/203.12
2011/0290269 A1 * 12/2011 Shimizu ..... A61M 15/0023 131/330
2012/0204889 A1 * 8/2012 Xiu ..... A24F 47/008 131/273
2012/0285476 A1 11/2012 Hon
2012/0298123 A1 * 11/2012 Woodcock ..... A24B 15/165 131/328
2013/0014755 A1 * 1/2013 Kumar ..... A24F 47/006 128/202.21
2013/0125906 A1 5/2013 Hon
2013/0139833 A1 6/2013 Hon
2013/0192615 A1 8/2013 Tucker et al.
2013/0192616 A1 8/2013 Turker et al.
2013/0276798 A1 10/2013 Hon
2013/0276804 A1 10/2013 Hon
2014/0190496 A1 * 7/2014 Wensley ..... A24F 47/008 131/273
2014/0209110 A1 7/2014 Hon
2014/0305448 A1 * 10/2014 Zuber ..... A24F 47/008 131/328
2015/0040929 A1 * 2/2015 Hon ..... A24F 47/008 131/329
2015/0335064 A1 * 11/2015 Abisdid ..... A24D 1/08 131/350
2016/0100624 A1 * 4/2016 Yilmaz ..... A24D 1/14 131/367
2016/0213063 A1 * 7/2016 Ajithkumar ..... A24B 3/14
2017/0340011 A1 * 11/2017 Batista ..... A24F 47/008
2018/0070641 A1 * 3/2018 Batista ..... A24F 47/008

FOREIGN PATENT DOCUMENTS

CN 101822420 A 9/2010
CN 201878765 U * 6/2011 ..... A24F 47/008
DE 10 2006 041 042 A1 3/2008
DE 102006041042 A1 * 3/2008 ..... A24F 47/008
DE 10 2006 041 042 B4 6/2009
EP 0 822 670 A2 2/1998
EP 2 022 349 A1 2/2009
EP 2003997 B1 * 10/2011 ..... A24F 47/002
JP 3074767 U 1/2001
JP 2009-521940 A 6/2009
JP 2013-532953 A 8/2013
RU 2 360 583 C1 7/2009
RU 2 389 419 C2 5/2010
WO WO 2009/134164 A1 11/2009
WO WO 2012/014490 A1 2/2012
WO WO 2013/098405 A2 7/2013
WO WO 2013/102614 A2 7/2013
WO WO 2013/116568 A2 8/2013
WO 2013/159245 A1 10/2013

OTHER PUBLICATIONS

Search Report dated Jun. 19, 2018 in Russian Patent Application No. 2016126610 (with English translation of categories of cited documents) citing references AA, AQ-AR, and AT therein, 3 pages.
Combined Office Action and Search Report dated Jun. 27, 2018 in Chinese Patent Application No. 201480064047.2 (submitting English translation only) citing references AO-AP therein, 8 pages.
Office Action dated Nov. 1, 2018 in Japanese Patent Application No. 2016-530145 (with English language translation).
Office Action dated Oct. 23, 2018 in Australian Patent Application No. 2014359185.
Chinese Office Action with English translation dated Mar. 11, 2019 in corresponding Chinese Patent Application No. 201480064047.2, citing document AA and A0 therein (18 pages).
Indian Office Action dated Oct. 10, 2019 in Indian Patent Application No. 201617021591, citing document AA therein, 8 pages
Korean Office Action dated Jul. 2, 2021 in Korean Patent Application No. 10-2016-7012216 (with English translation), citing documents AA and AB therein, 17 pages.

* cited by examiner

HEATED AEROSOL GENERATING ARTICLE WITH AIR-FLOW BARRIER

The present specification relates to heated aerosol-generating articles for use with an aerosol-generating device comprising a heating element, the articles having a lowered propensity for ignition, for example when brought into contact with a flame.

Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in conventional cigarettes.

A conventional cigarette is lit when a user applies a flame to one end of the cigarette and draws air through the other end. The localised heat provided by the flame and the oxygen in the air drawn through the cigarette cause the end of the cigarette to ignite, and the resulting combustion generates an inhalable smoke. By contrast in heated aerosol-generating articles, an inhalable aerosol is typically generated by the transfer of heat from a heat source to a physically separate aerosol-forming substrate or material, which may be located within, around or downstream of the heat source. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Heated aerosol-generating articles comprising tobacco for generation of an aerosol by heating rather than burning are known in the art. For example, WO2013/102614 discloses an aerosol-generating system comprising a heated aerosol-generating article and an aerosol-generating device having a heater for heating the heated aerosol-generating article to produce an aerosol.

Tobacco used as part of an aerosol-forming substrate in heated aerosol-generating articles is designer to produce an aerosol when heater rather than when burned. Thus, such tobacco typically contains high levels of aerosol formers, such as glycerine or propylene glycol. If a user were to light a heated aerosol-generating article and smoke it as if it were a conventional cigarette that user would not receive the intended user experience. It would be desirable to produce a heated aerosol-generating article that has a lowered propensity for flame ignition. Such a heated aerosol-generating article would be preferably difficult to light during attempts to light the article with a lighter, such as a flame, in the manner of traditional cigarettes.

A heated aerosol-generating article may be provided for use with an aerosol-generating device having a heating element. The heated aerosol-generating article comprises an aerosol-forming substrate and a breachable air-flow barrier assembled within a wrapper to form a rod. The rod has a mouth end and a distal end upstream from the mouth end, and the breachable air-flow barrier is positioned to substantially prevent air being drawn through the aerosol-forming substrate when a user draws on the mouth end of the rod. The aerosol-forming substrate comprises a gathered sheet of aerosol-forming material.

If a heat source, such as a flame or other cigarette lighter, is applied to the distal end of the heated aerosol-generating article and a user draws on the mouth end while the breachable air-flow barrier is intact, air will not be able to flow through the aerosol-forming substrate. Although the aerosol-forming substrate would be heated, the lack of air flow means that the propensity for ignition and combustion of the aerosol-forming substrate is reduced. Thus, the breachable air-flow barrier helps mitigate against the risk of a user igniting the aerosol-forming substrate by applying a flame, or other ignition source, to the aerosol-generating article. The risk of the article being ignited inadvertently or unintendedly is reduced.

The reduced propensity for ignition is the result of an increased effective resistance to draw (RTD) through the aerosol-forming substrate while the breachable air-flow barrier is intact. The entire heated aerosol-generating article may have a high RTD. Preferably the heated aerosol-generating article has RTD in excess of 1000 mm $H_2O$ when the air-flow barrier is intact, but between 30 and 100 mm $H_2O$ when the air-flow barrier is breached.

Preferably, the aerosol-generating article is a smoking article that generates an aerosol that is directly inhalable into a user's lungs through the user's mouth. More preferably, the aerosol-generating article is a smoking article that generates a nicotine-containing aerosol that is directly inhalable into a user's lungs through the user's mouth.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

For the avoidance of doubt, the term 'heating element' is used to mean one or more heating elements.

The breachable air-flow barrier may be disposed upstream of the aerosol-forming substrate. Alternatively, the breachable air-flow barrier may be disposed upstream of the mouth end but downstream of the aerosol forming substrate.

The breachable air-flow barrier may comprise a rupturable element spanning a cross-section of the rod to substantially prevent air-flow along the rod. In particular, air flow through the aerosol-forming substrate is substantially prevented. The rupturable element may be configured to be ruptured by physical interaction with a portion of an aerosol-generating device. The rupturable element may comprise a rupturable septum formed from a material such as foil, paper, polymer or ceramic. Such a rupturable septum may be designed to rupture when interacting with a rupturing member, such as a spike or projection, of an aerosol-generating device.

The breachable air-flow barrier may comprise a fusible septum disposed within the rod. For example, the fusible septum may be arranged to melt when heated by a heating element of an aerosol-generating device. The fusible septum may be a disc or plug of low melting point material, for example a wax such as paraffin wax.

The heated aerosol-generating article may comprise a plurality of elements, including the aerosol-forming substrate and the breachable air-flow barrier, assembled within a wrapper, such as a cigarette paper.

The heated aerosol-generating article is preferably for use with an aerosol-generating device that comprises an insertable heating element for insertion into a distal end of the heated aerosol-generating article. The heating element may be brought into contact with the aerosol-forming substrate within the aerosol-generating article by removing the breachable air-flow barrier or by rupturing the breachable air-flow barrier. Prior to use, the breachable air-flow barrier provides some mitigation against ignition of the aerosol-forming substrate using an external ignition source such as a flame.

The aerosol-forming substrate may be in the form of a rod comprising, or consisting of, a gathered sheet of aerosol-forming material circumscribed by a wrapper. The gathered sheet of aerosol-forming material may be a sheet of tobacco such as a sheet of homogenised tobacco. The aerosol-forming substrate is a solid aerosol-forming substrate. The aerosol-forming substrate does not comprise a reservoir of liquid.

The gathered sheet of material preferably extends along substantially the entire rod length of the rod and across substantially the entire transverse cross-sectional area of the rod.

Preferably, rods according to the specification are of substantially uniform cross-section.

Rods according to various aspects of the specification may be produced having different dimensions depending upon their intended use. The heated aerosol-generating article is in the form of a rod and the aerosol-forming substrate, which is a component part of the heated aerosol-generating article, may also be in the form of a rod.

Rods according to the specification may have a diameter of between about 5 mm and about 10 mm depending upon their intended use.

For example, rods according to the specification may have a rod length of between about 5 mm and about 150 mm depending upon their intended use.

In preferred embodiments, rods according to the specification for use as aerosol-forming substrates in heated aerosol-generating articles may have a rod length of between about 5 mm and about 20 mm or about 30 mm.

Rods according to the specification of a desired unit rod length may be produced by forming a rod of multiple unit rod length and then cutting or otherwise dividing the rod of multiple unit rod length into multiple rods of the desired unit rod length.

For example, rods having a rod length of about 15 mm for use as aerosol-forming substrates in heated aerosol-generating articles may be produced by forming a rod having a rod length of about 150 mm and then severing the elongate rod into ten rods having a rod length of about 15 mm.

As used herein, the term 'rod' is used to denote a generally cylindrical element of substantially circular, oval or elliptical cross-section.

As used herein, the term 'sheet' denotes a laminar element having a width and length substantially greater than the thickness thereof. The width of a sheet is greater than 10 mm, preferably greater than 20 mm or 30 mm.

As used herein, the term "co-laminated sheet" denotes a single sheet formed from two or more layers of material in intimate contact with one another.

As used herein, the term "aerosol-forming material" denotes a material that is capable of releasing volatile compounds upon heating to generate an aerosol. An aerosol-forming substrate may comprise or consist of an aerosol-forming material.

As used herein, the term 'rod length' denotes the dimension in the direction of the cylindrical axis of rods as described herein.

As used herein, the term 'homogenised tobacco material' denotes a material formed by agglomerating particulate tobacco.

As used herein, the term 'gathered' denotes that the sheet of tobacco material is convoluted, folded, or otherwise compressed or constricted substantially transversely to the cylindrical axis of the rod.

As used herein, the terms 'upstream' and 'downstream' are used to describe the relative positions of components, or portions of components, of aerosol-generating articles comprising rods as described herein in relation to the direction of air drawn through the aerosol-generating articles during use thereof.

The gathered sheet of aerosol-forming material may be a textured sheet of material. Use of a textured sheet of material may advantageously facilitate gathering of the sheet to form an aerosol-forming substrate as described herein.

As used herein, the term 'textured sheet' denotes a sheet that has been crimped, embossed, debossed, perforated or otherwise deformed. Textured sheets of material may comprise a plurality of spaced-apart indentations, protrusions, perforations or a combination thereof.

As used herein, the term 'crimped sheet' is intended to be synonymous with the term 'creped sheet' and denotes a sheet having a plurality of substantially parallel ridges or corrugations.

A number of aerosol-generating articles in which an aerosol-forming substrate is heated rather than combusted have been proposed in the art. Typically in heated aerosol-generating articles, an aerosol is generated by the transfer of heat from a heat source, for example a chemical, electrical or combustible heat source, to a physically separate aerosol-forming substrate, which may be located within, around or downstream of the heat source.

As used herein, the term 'aerosol-forming substrate' denotes a substrate consisting of or comprising an aerosol-forming material that is capable of releasing volatile compounds upon heating to generate an aerosol.

Rods used as aerosol-forming substrates in heated aerosol-generating articles are typically significantly shorter in rod length than rods of combustible smokable material in conventional lit-end smoking articles.

In preferred embodiments, the heated aerosol-generating articles described herein are for use in electrically-operated aerosol-generating systems in which the aerosol-generating substrate of the heated aerosol-generating article is heated by an electrical heat source. Such heated aerosol-generating articles are frequently constructed having an aerosol-forming substrate at a distal end. Thus, a user may inadvertently attempt to light the article in a traditional manner. The reduced ignition propensity of heated aerosol-generating articles comprising a breachable air-flow barrier may advantageously dissuade a user from attempting to ignite the article.

Heated aerosol-generating articles may be of the type disclosed in EP-A-0 822 670.

Preferred embodiments of aerosol-generating articles comprise gathered sheets of homogenised tobacco material as the aerosol-forming substrate. In certain embodiments, sheets of homogenised tobacco material may have a tobacco content of at least about 40% by weight on a dry weight basis or of at least about 50% by weight on a dry weight basis. In other embodiments, sheets of homogenised tobacco material may have a tobacco content of about 70% or more by weight on a dry weight basis. The use of sheets of homogenised tobacco material having high tobacco content advantageously generates aerosols with enhanced tobacco flavour.

Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Homogenised tobacco material may comprise between about 1% and about 5% non-tobacco fibres by weight on a dry weight basis.

Suitable aerosol-formers and humectants for inclusion in sheets of homogenised tobacco material are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, sheets of homogenised tobacco material may have an aerosol former content of between about 5% and about 30% by weight on a dry weight basis. Heated aerosol-generating articles may preferably include homogenised tobacco having an aerosol former content of greater than 5% to about 30%. The aerosol former may preferably be glycerine.

Sheets of homogenised tobacco material for use in forming heated aerosol-generating articles as described herein are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

For example, in certain embodiments sheets of homogenised tobacco material may be formed from slurry comprising particulate tobacco, guar gum, cellulose fibres and glycerine by a casting process.

Sheets of homogenised tobacco material may be textured using suitable known machinery for texturing filter tow, paper and other materials.

For example, sheets of homogenised tobacco material may be crimped using a crimping unit of the type described in CH-A-691156, which comprises a pair of rotatable crimping rollers. However, it will be appreciated that sheets of homogenised tobacco material may be textured using other suitable machinery and processes that deform or perforate the sheets of homogenised tobacco material.

Preferably, sheets of tobacco material for use in forming aerosol-forming substrates of heated aerosol-generating articles have a width of at least about 25 mm. In certain embodiments sheets of material may have a width of between about 25 mm and about 300 mm. Preferably, the sheets of material have a thickness of at least about 50 μm to about 300 μm. In certain embodiments, individual sheets of material may have a thickness of between 10 μm and about 250 μm. In certain embodiments, sheets of homogenised tobacco material may have a grammage 100 $g/m^2$ and about 300 $g/m^2$.

A method may be provided of forming an aerosol-forming substrate for a heated aerosol-generating article. The method may comprise the steps of: providing a continuous sheet comprising an aerosol-forming material; gathering the sheet transversely relative to the longitudinal axes thereof; circumscribing the gathered sheet with a wrapper to form a continuous rod, and severing the continuous rod into a plurality of discrete rods of aerosol-forming substrate. The aerosol-forming material may be any aerosol-forming material described above, and is preferably homogenised tobacco. In certain embodiments the wrapper is any suitable material such as a cigarette paper.

The method may further comprise texturing the continuous sheet. For example, the method may comprise crimping, embossing, perforating or otherwise texturing the continuous sheet prior to gathering.

A system may be provided comprising a heated aerosol-generating device and an aerosol-generating article for use with the device. The aerosol-generating article may be any heated aerosol-generating article as described herein. For example, a system may comprise a heated aerosol-generating article comprising an aerosol-forming substrate and a breachable air-flow barrier assembled within a wrapper to form a rod having a mouth end and a distal end upstream from the mouth end, in which the breachable air-flow barrier is positioned to substantially prevent air being drawn through the aerosol-forming substrate when a user draws on the mouth end of the rod. The system may further comprise an aerosol-generating device having a heating element, the aerosol-generating device comprising means for breaching the breachable air-flow barrier of the aerosol-generating article to allow air to be drawn through the aerosol-forming substrate when a user draws on the mouth end of the rod.

The aerosol-generating device may comprise a breaching element arranged to be inserted into the distal end of the heated aerosol-generating article when the heated aerosol-generating article is engaged with the aerosol-generating device to breach the breachable air-flow barrier. The breaching element may be a heating element for heating the aerosol-forming substrate. Alternatively, the breaching element may be a projection that does not function as a heating element.

A method of smoking a heated aerosol-generating article comprising an aerosol-forming substrate and a breachable air-flow barrier assembled within a wrapper to form a rod having a mouth end and a distal end upstream from the mouth end may be provided. The method comprises the steps of; a) coupling the distal end of the rod with an aerosol-generating device having a heating element, b) breaching the breachable air-flow barrier, c) actuating the heating element to heat the aerosol-forming substrate and generate an aerosol, and d) inhaling the aerosol through the mouth end of he rod. Steps a), b) and c) may be carried out in any order.

The step of coupling the distal end of the rod with the aerosol-generating device may cause a breaching element to penetrate the distal end of the aerosol-generating article thereby breaching the breachable air-flow barrier.

The step of actuating the heating element to heat the aerosol-forming substrate may cause a fusible septum to melt thereby breaching the breachable air-flow barrier.

Specific embodiments will be further described, by way of example only, with reference to the accompanying drawings in which.

Figure 1:
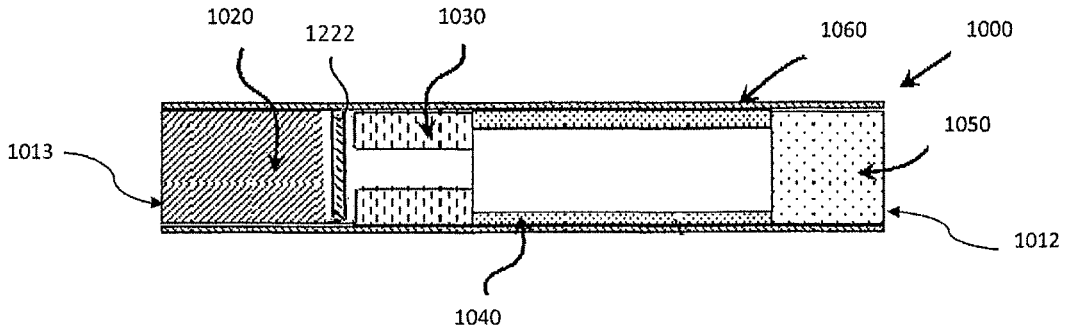
FIG. 1 illustrates an embodiment of an aerosol-generating article as described herein.

FIG. 1 illustrates an embodiment of a heated aerosol-generating article 1000 comprising a rod as described herein. The article 1000 comprises five elements; an aerosol-forming substrate 1020, a breachable air-flow barrier 1222, a hollow cellulose acetate tube 1030, a spacer element 1040, and a mouthpiece filter 1050. These five elements are arranged sequentially and in coaxial alignment and are assembled by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 1 is particularly suitable for use with an electrically-operated aerosol-generating device comprising a heater for heating the aerosol-forming substrate. The article could also be used with other types of aerosol-generating devices, for example aerosol-generating articles with gas-powered heaters.

When assembled, the article 1000 is about 45 millimetres in length and has an outer diameter of about 7.2 millimetres and an inner diameter of about 6.9 millimetres.

The aerosol-forming substrate 1020 comprises a rod formed from a crimped and gathered sheet of homogenised tobacco wrapped in filter paper to form a plug. The breachable airflow barrier is a frangible paper disc located downstream of the aerosol-forming substrate and upstream of the hollow cellulose acetate tube 1030. A user may inadvertently attempt to ignite the aerosol forming substrate 1020 by applying a flame to the distal end 1013 and simultaneously drawing air through the mouthpiece. Should this occur, the frangible paper disc will prevent air-flow through the heated aerosol-generating article, thereby restricting the oxygen available in the region of the aerosol-forming substrate for ignition and combustion. This lowered propensity for ignition and combustion may be sufficient for the user to desist in attempts to ignite the article.

Figure 2:
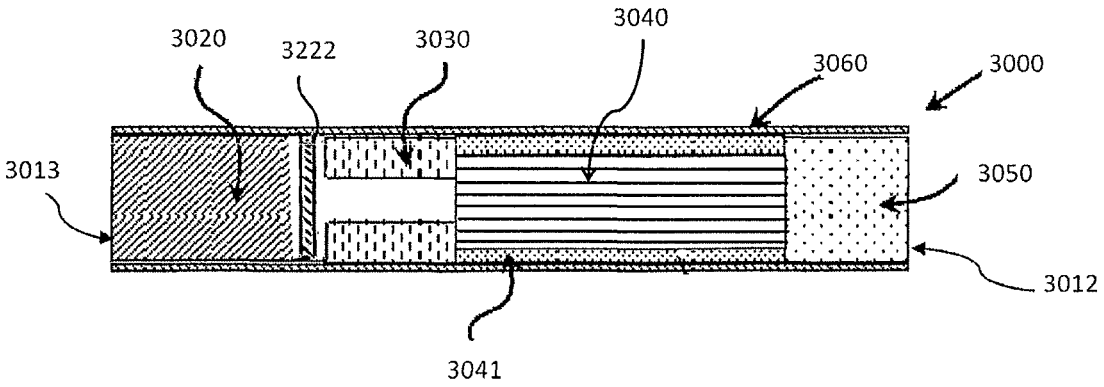
FIG. 2 illustrates an alternative embodiment of an aerosol-generating article as described herein

An aerosol-generating article 1000 as illustrated in FIG. 2 is designed to engage with an aerosol-generating device in order to be consumed. Such an aerosol-generating device includes means for heating the aerosol-forming substrate 1020 to a sufficient temperature to form an aerosol. Typically, the aerosol-generating device may comprise a heating element that surrounds the aerosol-generating article 1000 adjacent to the aerosol-forming substrate 1020, or a heating element that is inserted into the aerosol-forming substrate 1020. The breachable airflow barrier could alternatively be a ceramic disc or a foil disc.

FIG. 2 illustrates an alternative embodiment of a heated aerosol-generating article 3000 comprising a rod as described herein. The article 3000 comprises five elements; an aerosol-forming substrate 3020, a breachable air-flow barrier 3222, a hollow cellulose acetate tube 3030, an aerosol-cooling element 3040, and a mouthpiece filter 3050. The aerosol-cooling element 3040 acts as a spacer element as described in relation to FIG. 1 as well as an aerosol-cooling element. In use, volatile substances released from the aerosol-forming substrate 3020 pass along the aerosol-cooling element 3040 towards a mouth end 3012 of the aerosol-generating article 3000. The volatile substances may cool within the aerosol-cooling element 3040 to form an aerosol that is inhaled by the user. In the embodiment illustrated in FIG. 2, the aerosol-cooling element comprises a crimped and gathered sheet of polylactic acid circumscribed by a wrapper. These five elements are arranged sequentially and in coaxial alignment and are assembled by a cigarette paper 3060 to form the aerosol-generating article 3000. The article 3000 has a mouth-end 3012, which a user inserts into his or her mouth during use, and a distal end 3013 located at the opposite end of the article to the mouth end 3012.

Figure 3:
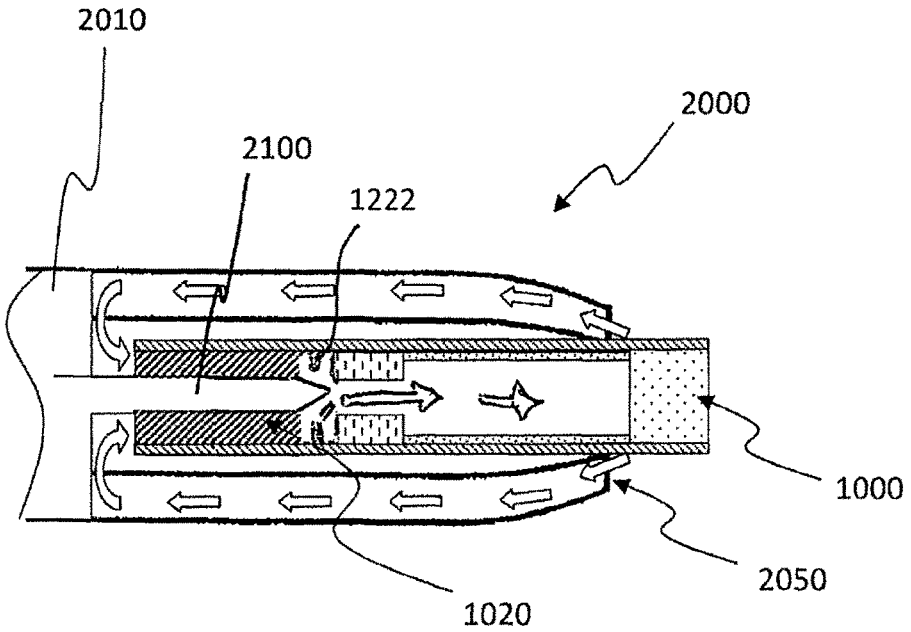
FIG. 3 illustrates an aerosol-generating system comprising an electrically-operated aerosol-generating device and an aerosol-generating article as illustrated in FIG. 1.

FIG. 3 illustrates a portion of an electrically-operated aerosol-generating system 2000 that utilises a heating blade 2100 to heat an aerosol-generating substrate 1020 of an aerosol-generating article 1000, 3000. The heating blade is mounted within an aerosol article receiving chamber of an electrically-operated aerosol-generating device 2010. The aerosol-generating device defines a plurality of air holes 2050 for allowing air to flow to the aerosol-generating article 1000. On engagement with the aerosol-generating device 2010 frangible paper disc 1222 is ruptured by the heating blade 2100, which passes through the aerosol—forming substrate. Thus, when the heating blade is actuated and a user draws on the mouth end of the aerosol-generating article, air is able to flow into the article and deliver an aerosol to the user through the mouth end. Air flow is indicated by arrows on FIG. 3.

Figure 4:
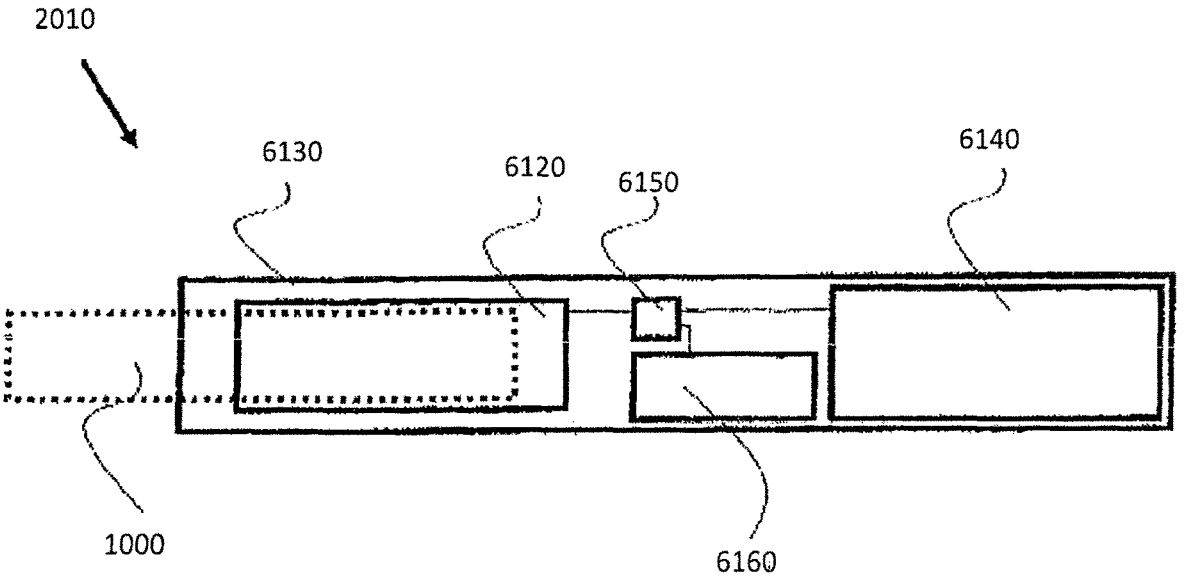
FIG. 4 is a schematic cross-sectional diagram of the aerosol-generating device illustrated in FIG. 3.

The aerosol-generating device comprises a power supply and electronics, which are illustrated in FIG. 4. The aerosol-generating article 1000 of FIG. 4 is as described in relation to FIG. 1. Once engaged with an aerosol-generating device, a user draws on the mouth-end 1012 of the smoking article 1000 and the aerosol-forming substrate 1020 is heated to a temperature of about 375 degrees Celsius. At this temperature, volatile compounds are evolved from the sheet of cast-leaf tobacco of the aerosol-forming substrate 1020. These compounds condense to form an aerosol. The aerosol is drawn through the filter 1050 and into the user's mouth.

In FIG. 4, the components of the aerosol-generating device 2010 are shown in a simplified manner. Particularly, the components of the aerosol-generating device 2010 are not drawn to scale in FIG. 4. Components that are not relevant for the understanding of the embodiment have been omitted to simplify FIG. 4.

As shown in FIG. 4, the aerosol-generating device 2010 comprises a housing 6130. The heating element 6120 is mounted within an aerosol-generating article receiving chamber within the housing 6130. The aerosol-generating article 1000 (shown by dashed lines in FIG. 4) is inserted into the aerosol-generating article receiving chamber within the housing 6130 of the aerosol-generating device 2010 such that the heating element 6120 is directly inserted into the aerosol-forming substrate 1020 of the aerosol-generating article 1000.

Within the housing 6130 there is an electrical energy supply 6140, for example a rechargeable lithium ion battery. A controller 6150 is connected to the heating element 6120, the electrical energy supply 6140, and a user interface 6160, for example a button or display. The controller 6150 controls the power supplied to the heating element 6120 in order to regulate its temperature.

The exemplary embodiments described above are not limiting. In view of the above-discussed exemplary embodiments, other embodiments consistent with the above exemplary embodiment will now be apparent to one of ordinary skill in the art.

The invention claimed is:

1. An aerosol-generating article for use with an aerosol-generating device having a heating element, the aerosol-generating article comprising:

an aerosol-forming substrate comprising a gathered sheet of aerosol-forming material;

a breachable air-flow barrier;

a tubular element defining an air-flow passage;

a mouthpiece filter; and a wrapper circumscribing the aerosol-forming substrate, the breachable air-flow barrier, the tubular element, and the mouthpiece filter to form a rod having a mouth end and a distal end upstream from the mouth end, the mouthpiece filter being at the mouth end, the rod being insertable into the aerosol-generating device such that the aerosol-forming substrate is heatable by the heating element, wherein the breachable air-flow barrier is positioned to substantially prevent air being drawn through the aerosol-forming substrate when a user draws on the mouth end of the rod prior to the rod being inserted into the aerosol-generating device, wherein the breachable air-flow barrier is disposed upstream of the mouth end but downstream of the aerosol forming substrate, and wherein the tubular element is disposed between the breachable air-flow barrier and the mouthpiece filter.

2. The aerosol-generating article according to claim 1, the article having a resistance to draw (RTD) in excess of 1000 mm $H_2O$ when the breachable air-flow barrier is intact, but between 30 mm $H_2O$ and 100 mm $H_2O$ when the breachable air-flow barrier is breached.

3. The aerosol-generating article according to claim 1, wherein the breachable air-flow barrier comprises a rupturable element spanning a cross-section of the rod to substantially prevent air-flow.

4. The aerosol-generating article according to claim 3, wherein the rupturable element is configured to be ruptured by physical interaction with a portion of the aerosol-generating device.

5. The aerosol-generating article according to claim 4, wherein the rupturable element comprises a rupturable septum formed from a foil, a paper, a polymer, or a ceramic.

6. The aerosol-generating article according to claim 1, wherein the breachable air-flow barrier comprises a fusible septum disposed within the rod.

7. The aerosol-generating article according to claim 6, wherein the fusible septum is configured to melt when heated by a heating element of the aerosol-generating device.

8. The aerosol-generating article according to claim 6, wherein the fusible septum is a low melting point wax in a shape of a disc or a plug.

9. The aerosol-generating article according to claim 8, wherein the low melting point wax is paraffin wax.

10. The aerosol-generating article according to claim 1, wherein the aerosol-generating article is for an electrically-operated aerosol-generating device having the heating element.

11. The aerosol-generating article according to claim 1, wherein the rod is insertable into the aerosol-generating device such that the heating element ruptures the breachable air-flow barrier.

12. The aerosol-generating article according to claim 1, wherein the rod is insertable into the aerosol-generating device such that the heating element is brought into contact with the aerosol-forming substrate.

13. The aerosol-generating article according to claim 1, wherein the rod is insertable into the aerosol-generating device such that the heating element ruptures the breachable air-flow barrier and the heating element is brought into contact with the aerosol-forming substrate.

14. The aerosol-generating article according to claim 1, wherein the gathered sheet of aerosol-forming material extends along substantially an entire length of the aerosol-forming substrate and across substantially an entire transverse cross-sectional area of the aerosol-forming substrate.

15. The aerosol-generating article according to claim 1, wherein the heating element is a heating blade.

* * * * *